US005158653A

United States Patent [19]

Lashmore et al.

[11] Patent Number: 5,158,653

[45] Date of Patent: Oct. 27, 1992

[54] METHOD FOR PRODUCTION OF PREDETERMINED CONCENTRATION GRADED ALLOYS

[76] Inventors: David S. Lashmore, 5506 Woodlyn Rd., Frederick, Md. 21701; Moshe P. Dariel, 55 Rotem Street, Omer 84965, Israel

[21] Appl. No.: 249,531

[22] Filed: Sep. 26, 1988

[51] Int. Cl.[5] ..... C25D 5/10

[52] U.S. Cl. ..... 205/103; 204/192.12; 204/192.15; 204/DIG. 9; 427/255.7; 427/404; 427/405; 205/176

[58] Field of Search ..... 204/40, DIG. 9, 192.1, 204/192.11, 192.12, 192.15; 428/610, 635; 427/255.7, 404, 405, 406

[56] References Cited

U.S. PATENT DOCUMENTS

| | | | |
|---|---|---|---|
| 4,093,453 | 6/1978 | Makino et al. | 75/129 |
| 4,461,680 | 7/1984 | Lashmore | 204/41 |
| 4,576,699 | 3/1986 | Sato et al. | 204/192 M |
| 4,652,348 | 3/1987 | Yahalom et al. | 204/40 |
| 4,666,567 | 5/1987 | Loch | 204/14.1 |
| 4,851,095 | 7/1989 | Scobey et al. | 204/192.12 |
| 4,869,971 | 9/1989 | Nee et al. | 428/635 |

FOREIGN PATENT DOCUMENTS

| | | | |
|---|---|---|---|
| 2062552 | 9/1971 | Fed. Rep. of Germany | 428/635 |
| 1420078 | 8/1988 | U.S.S.R. | |

OTHER PUBLICATIONS

Lashmore et al., "Electrodeposition of Artificially Layered Materials," Proc. of the AESF 1986 Pulse Plating Symposium.

Yahalom et al., "Formation of Composition-Modulated Alloys by Electrodeposition," 22 J. Materials Science 499 (1987).

Ogden, "High Strength Composite Copper-Nickel Electrodeposits," 73 Plating and Surface Finishing 130 (1986).

Tench et al., "Enhanced Tensile Strength for Electrodeposited Nickel-Copper Multilayer Composites," 15A Metallurgical Transactions A 2039 (1984).

Goldman et al., "Short Wavelength Compositionally Modulated Ni/Ni-P Films Prepared By Electrodeposition," 60 J. Appl. Phys. 1374 (1986).

Cohen et al., "Electroplating of Cyclic Multilayered Alloy (CMA) Coatings," 130 J. Electrochem. Soc. 1987 (1983).

W. Fedrowitz, Chrome/Copper Laminated Stud Via, IBM Technical Disclosure Bulletin, vol. 19, No. 6, Nov., 1976, p. 2060.

*Primary Examiner*—John F. Niebling
*Assistant Examiner*—William T. Leader

[57] ABSTRACT

A process for the production of a composition modulated alloy having a predetermined concentration is disclosed, in which alternating layers of at least two metals are successively deposited upon a substrate by electrodeposition, vacuum deposition, vapor deposition, or sputtering. The individual thicknesses of at least one metal's layers are varied in a predetermined manner. Pulsed galvanostatic electrodeposition using a tailored waveform is preferred. A copper-nickel concentration graded alloy is disclosed. Concentration graded alloys of predetermined concentration having at least one region of local homogeneity are also disclosed. The region of local homogeneity has a thickness corresponding to the thickness of two adjacent layers of different metals which have been diffusion annealed together. A pulsed electrodeposition/diffusion anneal process for production of such alloys is also disclosed. An electrochemical deposition method is also disclosed for the production of a non-layered, continuous concentration graded alloy.

8 Claims, 4 Drawing Sheets

METHOD FOR PRODUCTION OF PREDETERMINED CONCENTRATION GRADED ALLOYS

BRIEF DESCRIPTION OF THE TECHNICAL FIELD

The present invention relates to concentration graded alloys. More particularly, the present invention relates to predetermined concentration graded multilayer alloys and processes for the production of such alloys.

"Composition modulated alloys" are made of alternating layers of different metals or alloys and are typically prepared by vacuum deposition, molecular beam epitaxy or sputtering. For example, U.S. Pat. No. 4,576,699 discloses a periodic multilayer coating comprising a plurality of layers, each of which contains a rare earth metal and a transition metal, which have been simultaneously co-sputtered onto a substrate. The relative concentration ratio of the two metals may be cyclically varied with the thickness of the coating by providing relative movement between the substrate and the metal sources during co-sputtering.

Electrodeposition has been used successfully for the production of composition modulated materials having a layer thickness of less than 10 nm. For example, U.S. Pat. No. 4,461,680 discloses a pulsed electrodeposition process for production of composition modulated nickel-chromium alloys having a layer spacing of from 0.2 to 0.6 micron. See also U.S. Pat. No. 4,652,348. Both potentiostatic and galvanostatic electrodeposition techniques have been employed to produce composition modulated alloys. Potentiostatic electrodeposition typically produces a composition modulated alloy having sharp layer interfaces, but variable layer thickness. Galvanostatic electrodeposition typically produces a diffuse interface on one side of the layer. Galvanostatic electrodeposition employing "tailored" plating pulse waveforms has been suggested as a means to produce a composition modulated alloy having either sharp layer boundaries or graded interfaces between layers comprising a controlled concentration gradient. Lashmore et al, *Electrodeposition of Artificially Layered Materials,* Proc. 1986 AESF Third International Pulse Plating Symposium.

"Concentration graded alloys" are metallic or intermetallic materials which display a concentration gradient in a given direction. Such alloys can be prepared, in principle, as the outcome of a chemical diffusion reaction occurring between the two constituents of a diffusion couple. However, the concentration profile obtained as the result of a diffusion reaction is determined by the nature of the constituents of the diffusion couple, the equilibrium diagram of the system and the parameters (duration, temperature) of the diffusion anneal, and permits only limited latitude for designing a concentration gradient according to specific requirements.

Cohen et al, "Electroplating of Cyclic Multilayered Alloy (CMA) Coatings," 130 J. Electrochem. Soc'y 1937 (1983) employ square and triangular waveforms to galvanostatically electrodeposit a variety of Ag—Pd cyclic multilayered alloy deposits, and suggest modifying the alloy structure to obtain laminated coatings which may have desirable engineering properties.

An object of the present invention is to provide processes for the production of composition graded multilayer alloys having predeterminable concentration gradients.

Another object of the present invention is to provide composition modulated alloys comprising a plurality of alternating layers of at least two metals in which at least one metal's layer thickness is varied in a predetermined manner over the overall thickness of the alloy.

BRIEF SUMMARY OF THE INVENTION

In one aspect, the present invention relates to a process for the production of a composition modulated alloy having a predetermined variation of wavelength with thickness comprising depositing alternating layers of at least two metals upon a substrate such that the ratio of one layer's thickness to the other remains constant, and the wavelength changes in a predetermined manner over the overall thickness of the alloy.

In a preferred embodiment, the present invention relates to a process for the production of a composition modulated alloy having a predetermined concentration gradient, comprising:

i) providing an electrolyte containing a first metal and a second metal;

ii) providing a substrate upon which said first metal and said second metal are to be electrodeposited;

iii) at least partially immersing said substrate in said electrolyte;

iv) passing an electric current through said substrate, said electric current being alternately pulsed for predetermined durations between a first value corresponding to a reduction potential of said first metal and a second value corresponding to a reduction potential of said second metal to produce a composition modulated alloy having alternating layers of said first metal and said second metal on a surface of said substrate; such that the ratio of one layer's thickness to the other layer's thickness remains constant and the wavelength changes in a predetermined manner over the overall thickness of the alloy.

In another aspect, the present invention relates to a composition modulated alloy comprising a plurality of alternating layers of at least two metals, in which the ratio of at least one metal's layer thickness to the other remains constant, and the wavelength changes in a predetermined manner over the overall thickness of the alloy.

In still another aspect, the present invention relates to a process for the production of a composition modulated alloy having a constant wavelength and a predetermined variation in layer of at least two metals upon a substrate such that the wave-length of the layer remains constant, and the ratio of one layer's thickness to the other layer's thickness is varied in a predetermined manner.

In yet another aspect, the present invention relates to a composition modulated alloy comprising a plurality of alternating layers of at least two metals, in which the wavelength remains constant, and the ratio of the first metal layer thickness to the second metal layer thickness changes in a predetermined manner over the overall thickness of the alloy.

The present invention also relates to a process for the production of a continuously graded alloy having a predetermined concentration gradient, comprising:

providing an electrolyte containing a first metal and a second metal;

providing a substrate upon which said first metal and said second metal may be electrodeposited;

at least partially immersing said substrate in said electrolyte;

providing an electrical potential at said substrate, the magnitude of said potential being effective to cause codeposition of said first and second metals onto said substrate; and varying said potential over time such that the relative amounts of said first and second metal being co-deposited onto said substrate varies in a predetermined manner.

DETAILED DESCRIPTION OF THE PREFERRED EMBODIMENTS

Figure 1:
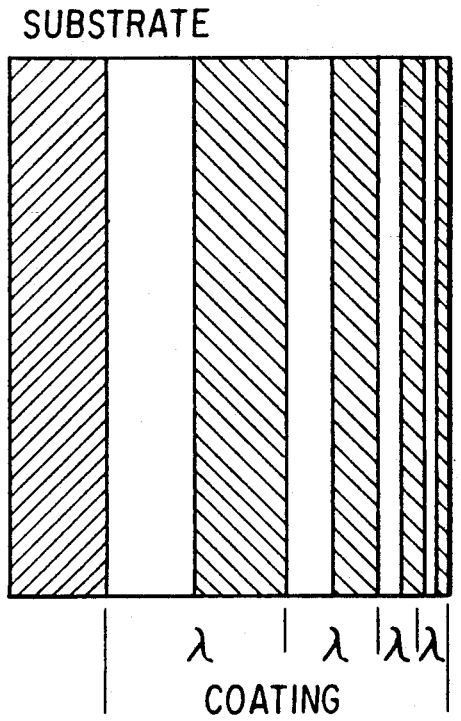
FIG. 1 is an enlarged schematic cross section which depicts a multilayer alloy of the present invention having a constant ratio of one layer's thickness to the other layer's thickness, and having a wavelength which changes in a predetermined manner over the overall thickness of the alloy.
Figure 2:
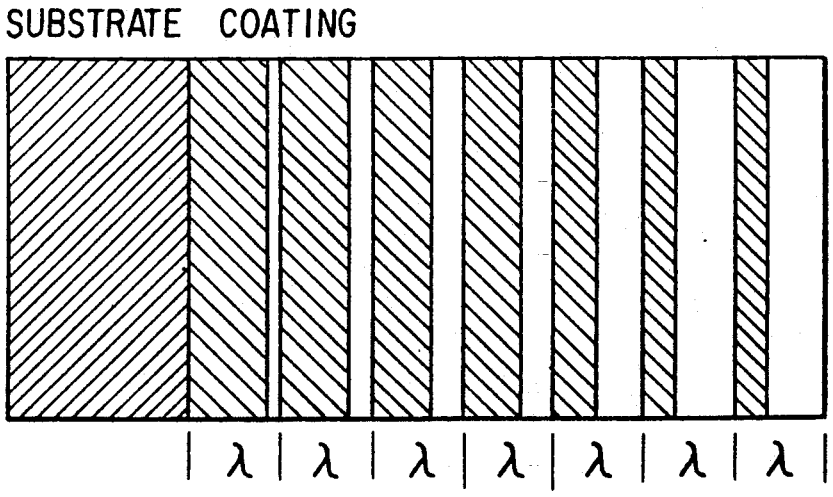
FIG. 2 is an enlarged schematic cross section which depicts a multilayer alloy of the present invention having a constant wavelength and a ratio of one layer's thickness to the other layer's thickness which changes in a predetermined manner over the overall thickness of the alloy.

The total thickness of a multilayer composition modulated alloy is large compared with individual layer thicknesses. "Wavelength" (also known as "periodicity") means the combined thickness of two adjacent layers of a multilayer alloy. A "constant ratio" concentration gradient within a multilayer alloy can be produced by a deposition process in which the ratio of one layer's thickness to the other layer's thickness is maintained constant, but which varies the wavelength of the alloy in a predetermined manner over the overall thickness of the alloy. One possible structure of such a "constant ratio, variable wavelength" multilayer alloy is illustrated in FIG. 1. A desired concentration gradient within a multilayer alloy can also be achieved by carrying out a deposition process so that the wavelength of the multilayer alloy remains constant, but the relative thickness of two adjacent layers of different metals or alloys changes in a predetermined way. One possible structure of such a "constant wavelength, variable ratio" multilayer alloy is illustrated in FIG. 2. Multilayer alloys in which both the wavelength and the ratio are both varied over the overall thickness of the deposit are also within the scope of the invention.

The graded alloys of the present invention may be produced by a variety of deposition techniques including vapor depositing sputtering and pulsed electrodeposition. Pulsed electrodeposition is preferred.

Electroplating techniques are well known to those of ordinary skill in the deposition arts, and therefore need not be discussed in detail. In general, alternating layers of a first and second metal or alloy may be deposited upon a cathode substrate by pulsing from one deposition parameter (at which primarily the first metal or alloy is deposited on the substrate) to a second deposition parameter at which primarily only the second metal or alloy is deposited. Codeposition can be largely avoided by proper selection of deposition potentials and the relative concentrations of the metals to be deposited. This technique is described in more detail by U.S. Pat. No. 4,652,348, the disclosure of which is hereby incorporated by reference in its entirety herein.

The predetermined variation in wavelength or layer thickness ratio can be produced by intentionally varying the appropriate electrodeposition parameter during the course of the deposition. For example, a "constant wavelength, variable ratio" multilayer copper/nickel alloy can be produced by using a copper/nickel electrolyte similar to that described by Tench and White (Metall. Trans. A, 15, 2039 (1984). A square waveform is used which corresponds in potential to that for the more noble metal (copper) at one level and that for the less noble metal (nickel) at a second level. This waveform has a ratio (R) of the pulse lengths corresponding to the deposition of the more noble element to the less noble element respectively. The deposition time for each layer is determined by the charge required to deposit a preselected amount of the element or alloy. Once the desired amount of the first element has been deposited the potential is rapidly switched to the second value and continued for the time required to deposit the desired amount of the second element or alloy. The potential is then rapidly switched back to the first value in order to deposit a second layer of the first element or alloy. By repeating this process a multilayer alloy having hundreds of distinct layers may be formed.

Figure 3:
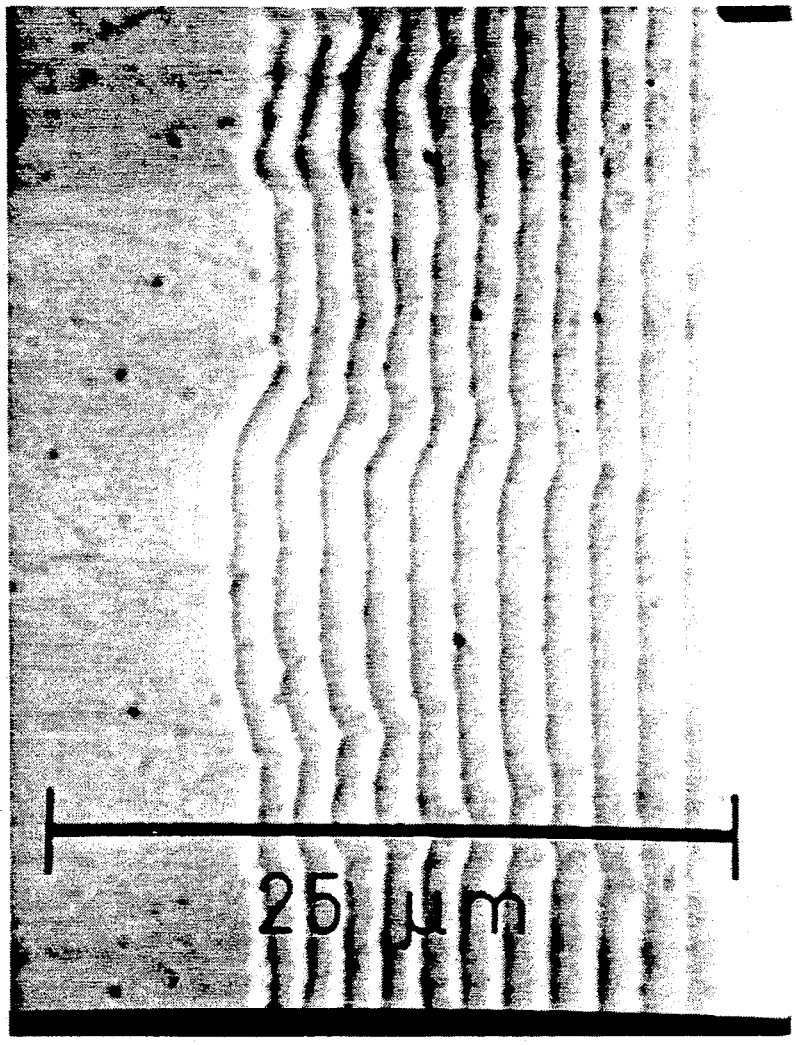
FIG. 3 is a photomicrograph of a Cu/Ni alloy having a "constant wavelength, variable ratio" structure.
Figure 5:
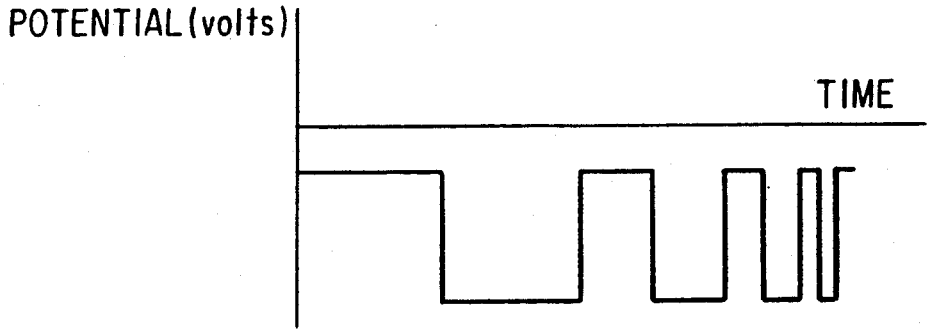
FIG. 5 is a schematic illustration of a waveform produced by potentiostatic charge controlled electrodeposition of a Cu/Ni alloy.

In order to produce a "constant wavelength, variable ratio" multilayer alloy, the square waveform ratio R may be varied in a predetermined manner so that R is a function of the thickness. Such a waveform is shown schematically in FIG. 5. The deposition process may be carried out under potentiostatic conditions with the voltage levels being changed only after the preselected amount of charge has been passed. It is important that the amount of charge be measured with a very fast coulometer due to the small amount of charge required for each individual layer thickness. A computer is preferably employed to control the deposition process. FIG. 3 is an optical micrograph of an electrodeposited copper-nickel multilayer alloy whose wavelength was maintained constant at about 1–2 microns, and whose ratio R was changed from 1:10 to 10:1.

Figure 4:
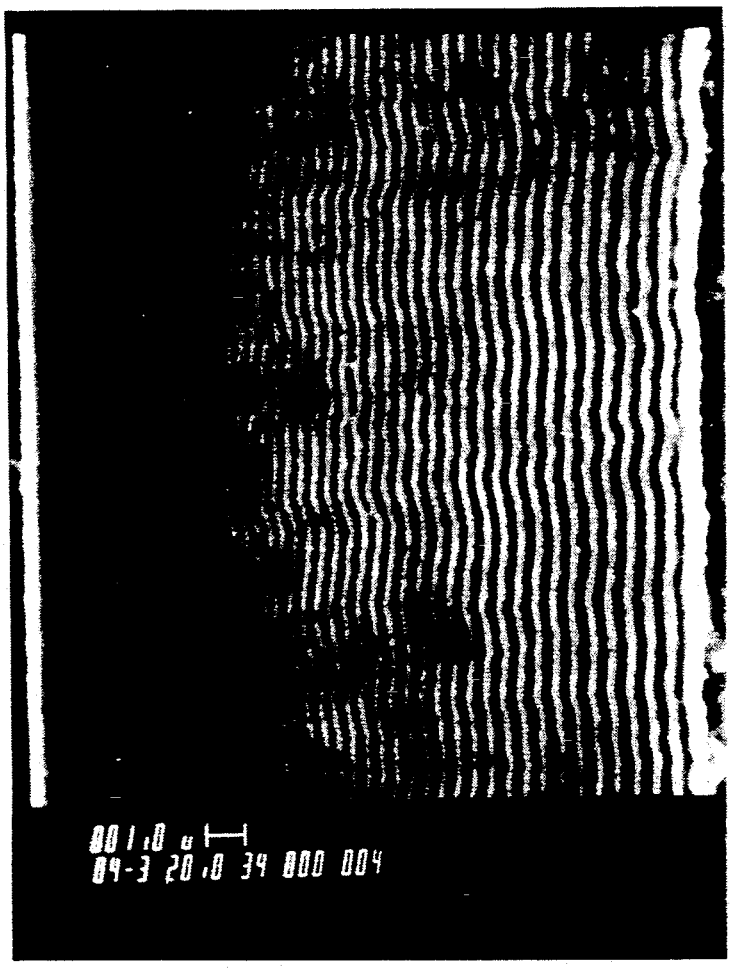
FIG. 4 is a graph of microhardness of a Cu/Ni alloy having a "constant ratio, variable wavelength" structure.

A "constant ratio, variable wavelength" multilayer alloy can be produced by using a copper/nickel electrolyte as described above with a waveform such that the ratio of the more noble to the less noble alloy remains constant (R=Constant) while the wavelength is deliberately varied with the thickness of the coating. FIG. 4 is an optical micrograph of an electrodeposited copper-nickel multilayer alloy whose wavelength was varied from 300 Angstroms to 3000 Angstroms. The ratio R was kept constant at 1:1.

In a preferred embodiment of the invention, the pulsed electrodeposition is controlled by actually measuring the amount of charge which has passed through the cathodic substrate, rather than by time control of the pulsed electrodeposition. An advantage of coloumetrically deposition is that individual layer thickness may be more precisely controlled, and that mass transport phenomena, solution effects, and other interfering deposition phenomena are accounted for when measuring the actual amount of charge which has passed through the cathodic substrate.

The multilayer composition modulated structures of the present invention may be heated in order to promote local (i.e., on a nanometer thickness scale) homogeneity. The diffusion anneal may be carried out under vacuum to prevent oxidation and at a temperature to ensure that even though local homogenization is achieved, the desired macro-concentration gradient (i.e. over the overall thickness of the deposit) is maintained. The temperature of the diffusion anneal is dependent on the alloy system investigated. For example, multilayer Cu-Ni modulated structures may be diffusion annealed in the 200° to 300° C. range. In multi-layer Sn—Ni composition modulated structures, where amorphization is expected and desired, the diffusion anneal should be carried out at a lower temperature (<100° C.) to prevent premature crystallization of the amorphous alloy.

The present invention also comprises a process for production of continuously concentration graded (i.e. non-layered) alloys in which the relative concentrations of the alloy components varies as a function of the thickness of the alloy. Such alloys may be produced by slowly changing the potential of the cathodic substrate rather than by pulsing (rapidly switching) from one reduction potential to another.

The concentration graded alloys of the present invention are important because many properties of commercial interest may be varied by varying the layer spacing or wavelength of the alloy. By electroforming an alloy whose wavelength varies from about 30nm to about 300nm a material can be created having a predetermined gradient in tensile properties.

Figure 6:
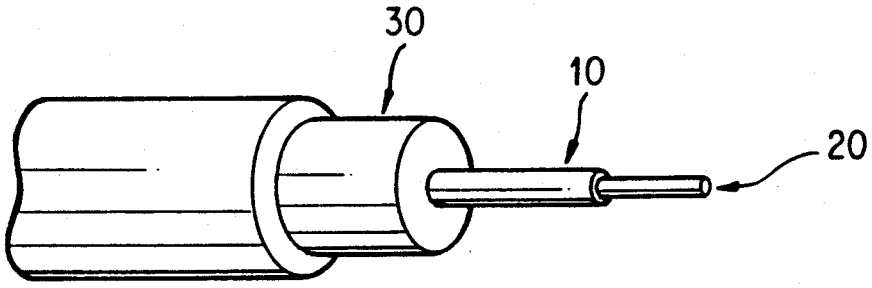
FIG. 6 is a schematic illustration of a fiber application of the present invention.

Another advantage of such a structure is the control of plastic deformation (i.e. the behavior of dislocations) near sharp interfaces, for example, in metal matrix composite structures. It can be expected that in homogeneous structures, dislocations will be concentrated at sharp interfaces and that voids may even form as a result. These voids can subsequently grow into cracks and result in failure of the material. In a graded structure, such plastic deformations can be distributed over a larger volume element, thereby reducing the possibility of crack formation. FIG. 6 illustrates a possible embodiment in which graphite fiber 20 is encased in an aluminum-manganese alloy. A nickel-tin graded structure alloy 10 of the present invention is interposed between graphite fiber 20 and an aluminum-manganese alloy 30 in order to enhance bonding of the alloy 30 to the fiber 10, and to control plastic deformation. Other metal alloys can include aluminum-titanium, aluminum-vanadium, cobalt-tungsten, nickel-tungsten, nickel-molybdenum and copper. Suitable fibers may include graphite, silicon-copper and boron.

Enhanced ultimate tensile stress and wear resistance are two specific examples of how control over structure on virtually an atomic scale provides a high degree of control over properties which can be thereby tailored for a given materials application. There are many other applications for graded materials; for example, alloys which reflect different x-rays (x-ray mirrors) can be created because the effective index of refraction (in the x-ray region of the spectrum) can be tailored. Similarly, alloys capable of reflecting neutrons may be produced by electrodepositing graded layers of selected elements such as nickel/tin or nickel/manganese. Alloys with magnetic properties which can be controlled on an atomic scale may also have broad application for magnetic mirrors or in magnetic based memory devices. Yet another possible application of the graded alloys of the present invention is in electrical contacts. It is well known that in electrical contacts that the maximum stress in the counterface occurs at a distance below the surface [see, for example, Nam P. Suh, *Tribophysics* at p. 105–140 (Prentice-Hall, Inc. Englewood Cliffs, N.J. 07632)]. A graded structure may be produced of, for example, cobalt or nickel and gold such that the yield stress or resistance to deformation is maximized below the surface and the outer surface is pure gold to maximize the conductivity of the contact.

Though the discussion and examples provided herein are directed to metallic alloys it is understood that the instant disclosure is equally applicable for polymers, intermetallics, and ceramics (all of which can be produced using electrochemical techniques with or without subsequent processing, such as thermal, radiation or mechanical treatment).

EXAMPLES

The following examples are merely intended to illustrate the practice and advantages of specific embodiments of the present invention; in no event are they to be used to restrict the scope of the generic invention.

EXAMPLE I

Preparation of Copper Substrates

Cold rolled 150μm thick copper sheet and 15 mm diameter copper single crystals are used as substrate materials. Disks (0.5–0.8 mm) are cut from the single crystals using a slow speed diamond saw. Preliminary work had shown that appropriate surface preparation is a critical requirement for obtaining a short wavelength layered, coherent structure. The polycrystalline copper substrate disks are spark eroded from the cold rolled sheet. The disks are hand polished to the 0.25μm diamond paste stage. They are then mounted in a specially designed PTFE sample holder which leaves exposed a 10 mm diameter circular surface while providing electrical contact to the back of the substrate. The substrates are finally electropolished in 50% phosphoric acid, using a jet polisher set-up, at 110 V DC, for 20 sec. Just before plating, the sample holder is briefly immersed in 10% $H_2SO_4$ solution in order to remove the substrate surface oxide layer and rinsed in distilled water.

EXAMPLE II

Formation of a Constant Ratio, Variable Wavelength Ni-Cu Alloy

A sulfamate nickel electrolyte containing 1.5 Molar Nickel Sulfamate, 4 g/L Copper sulfate ($CuSO_4$ $5H_2O$) 30 g/L Boric acid 3 ml/L Triton X100 (surfactant) operated at a pH of 3 and a temperature of 30 degrees centigrade is used in this example.

The cell design incorporates a anodic chamber separated from the cathode chamber by an ion selective membrane (NAFION) to keep anodic reaction products from being incorporated into the coating. The temperature is held at 30 degrees and controlled to within 1 degree. Since the composition of the more noble element (copper) is a sensitive function of the transport condition within the cell, no stirring (or agitation) of the electrolyte is allowed during the deposition process.

The deposition is conducted under potentiostatic control, that is, the potential of the cathode is held constant with respect to an appropriate reference electrode such as a calomel electrode. The decision of when to change the potential level is governed by the amount of charge passed, rather than by elapsed time. The deposition process is controlled by a microcomputer connected to a hybrid analog/digital coulometer. Appropriate software communicates with the coulometer, establishes charge levels for each layer for a given graduation in structure, and outputs the appropriate voltage level to a potentiostat connected to the deposition cell.

What is claimed is:

1. A process for the production of a composition modulated alloy having a predetermined concentration gradient comprising depositing upon a substrate a plurality of adjacent sets of metal layers, each set comprising at least two adjacent layers, said two adjacent layers being formed of a first metal and a second metal respectively, such that the individual layer thicknesses of said first metal and said second metal are varied in a predetermined manner and are different in each successive set, wherein the ratio of the layer thickness of said first metal to the layer thickness of said second metal remains constant in all sets and the combined thickness of the adjacent layers of said first metal and said second metal varies from one set to the next.

2. The process of claim 1 wherein said metals are deposited upon said substrate by a method selected from the group consisting of vapor deposition, sputtering and pulsed electrodeposition.

3. The process of claim 2 wherein said deposition method is pulsed electrodeposition.

4. The process of claim 3 wherein said deposition method is pulsed galvanostatic electrodeposition.

5. The process of claim 3 wherein said deposition method is pulsed potentiostatic electrodeposition.

6. The process of claim 5 wherein said pulsed potentiostatic electrodeposition is coulometrically controlled.

7. The process of claim 4 wherein a cathode potential is varied as a function of deposition thickness.

8. A process for the production of a multilayer alloy having a predetermined concentration gradient, comprising:

providing an electrolyte containing a first metal and a second metal;

providing a substrate upon which said first metal and said second metal may be electrodeposited;

at least partially immersing said substrate in said electrolyte;

passing an electric current through said substrate, said electric current being alternately pulsed for predetermined durations between a value corresponding to a reduction potential of said first metal and a value corresponding to a reduction potential of said second metal, thereby producing a composition modulated alloy having adjacent pairs of layers of said first metal and said second metal on an immersed surface of said substrate wherein the ratio of the layer thickness of said first metal to the layer thickness of said second metal in each pair remains constant, and the wavelength of the alloy varies from one pair to the next with the overall thickness of the alloy.

* * * * *